United States Patent [19]

Hällgren

[11] 4,258,656

[45] Mar. 31, 1981

[54] DEVICE IN SPRAY BOOTHS FOR E.G. SPRAY-PAINTING

[75] Inventor: Karl Hällgren, Huddinge, Sweden

[73] Assignee: Aktiebolaget Carl Munters, Sollentune, Sweden

[21] Appl. No.: 917,488

[22] Filed: Jun. 21, 1978

[30] Foreign Application Priority Data

Jun. 23, 1977 [SE] Sweden ..... 7707308

[51] Int. Cl.[3] ..... B05C 15/00

[52] U.S. Cl. ..... 118/666; 55/222; 55/227; 55/314; 98/115 SB; 118/326; 118/DIG. 7

[58] Field of Search ..... 118/DIG. 7, 634, 5, 118/326, 666, 695, 703; 98/115 SB; 55/222, 227, 314

[56] References Cited

U.S. PATENT DOCUMENTS

| | | | |
|---|---|---|---|
| 1,859,797 | 5/1932 | Ready | 118/DIG. 7 |
| 3,789,109 | 1/1974 | Lyon et al. | 55/222 X |
| 4,127,106 | 11/1978 | Jensen | 118/DIG. 7 |

*Primary Examiner*—John P. McIntosh

[57] ABSTRACT

The invention relates to spray booths intended for spraying or painting of articles and designed to be passed by a stream of atmospheric air admitted through inlet ducts and exhausted through outlet ducts and therebetween forced through a water curtain formed inside the spray booth for separating off paint particles remaining in turbulent movement in the air after ejection from a spray gun operating in the interior of said spray booth. To improve economy in the operation of the spray booth it is desirable to bring about heat exchange between the exhaust air and the incoming atmospheric air. However, due to excessive cooling of the exhaust air with its high moisture content and low temperature after passage through the water curtain by the heat exchange with the admitted atmospheric air of low temperature especially during the cooled season there is a great risk of ice precipitation in, and clogging of, the air passageways in the exchanger. This risk is eliminated according to the invention, by coordination of the operation of the spray gun with periodical interruption of the action of the water curtain.

10 Claims, 7 Drawing Figures

DEVICE IN SPRAY BOOTHS FOR E.G. SPRAY-PAINTING

FIELD OF THE INVENTION

This invention relates generally to a device in spray booths for e.g. spray-painting.

More particularly, this invention relates to a device in spray booths intended for painting or spraying of articles and passed by atmospheric air via inlet and outlet ducts, turbulent dust particles ejected from a spray gun during the spraying operation being separated off by forcing the air to pass through a water curtain.

BACKGROUND OF THE INVENTION

It has been suggested to provide between the two ducts in a spray booth a heat exchanger for improvement of the operation economy, especially during the winter season. However, experiments in this direction have not arrived at practical results i.e. due to the fact that the exhausted moist air by becoming cooled down in the exchanger causes formation of ice in the passageways of the exchanger so as to clog them. A spray booth is normally composed of a plurality of compartments or units each of which has a spray gun and inlet and outlet ducts for air and, in addition, means for generation of a water curtain. The booth or the units thereof are in operation for spraying during a minor portion only of a working-day. During the remainder of the working time these members thus are idle-running, i.e. the water curtain is kept operative which results in that the exhaust air continuously takes up moisture while its temperature is reduced. When this air during the cold season passes through the heat exchanger, it becomes cooled further so that its temperature falls below the dew or freezing point resulting in that ice is precipitated and clogs the passageways of the heat exchanger. The entering admitted air must be supplied with heat from a separate heat source both ahead of and behind the heat exchanger to eliminate the danger of ice-formation in the heat exchanger and to keep the interior of the booth at an acceptable temperature.

MAIN OBJECTS OF THE INVENTION

One object of the invention is to eliminate these drawbacks so that heat exchangers can be utilized in the spray booth while at the same time during the cold season the need of additionally supplied heat is reduced considerably.

A further object of the invention is to provide a spray booth which is operated under favorable conditions with regard to consumption of energy and water.

MAIN FEATURES OF THE INVENTION

According to a main feature of the invention an impulse or exciter means devised to be actuated by the spray gun is comprised in a control circuit of such nature that formation of the water curtain is initiated practically immediately on the start of operation of the gun but with delay only is shut off again on finishing of the operation of the gun. In this way the air passing through the booth or one or several units thereof will not, when the water curtain is shut off, be imparted additional moisture and thus not be cooled down for which reason precipitation of ice in the exhaust air channels of the heat exchanger can be avoided totally. Instead, a substantially improved heating of the supply air admitted into the preheater is obtained so that minor heat must be supplied to keep the temperature inside the booth during the cold season also at a desired level.

THE DRAWINGS

Further objects, features and advantages of the invention will become apparent from the following description of some embodiments of the invention considered in connection with the attached drawings which form part of this specification and of which:

FIG. 1 is a diagrammatic representation of a spray booth embodying the features of the invention, FIG. 2 is a diagrammatic representation of a modified embodiment of the invention, FIG. 3 is a diagrammatic representation of a further modified embodiment, FIG. 4 is a diagrammatic representation of still a further embodiment, FIGS. 5–7 show various psychometric charts.

In the drawings the same designations have been used for equivalent parts.

DETAILED DESCRIPTION OF PREFERRED EMBODIMENTS

Figure 1:
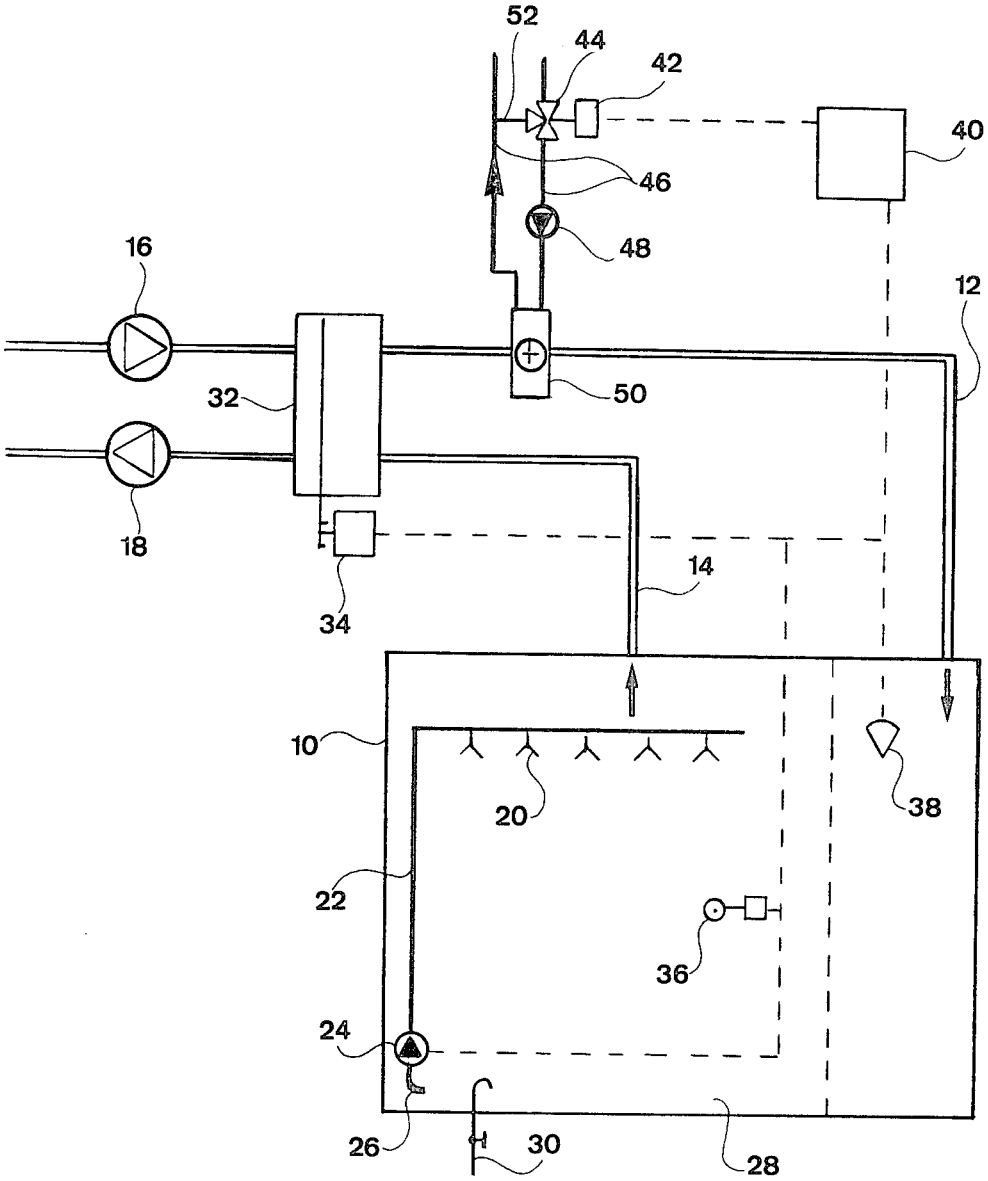

Referring now to the drawings and in particular to FIG. 1, reference numeral 10 denotes a spray booth. In most cases the spray booths are composed of a plurality of compartments or units, although only one such unit is represented in the FIGS. 1–4. Air is admitted into the spray booth from the external atmosphere through an inlet duct 12. Often the air enters through an ante-room and thereupon passes through the booth wherein spraying is effected and escapes thereafter through an exhaust duct 14. Disposed in the ducts are fans 16 and 18, respectively which force in the supply air into the room or suck out the exhaust air from the booth, respectively. A series of sprinklers 20 are fed with water through a pipe 22 within which a pump 24 is provided. This pipe 22 has a suction pipe 26 which opens into a water pool 28 in the bottom portion of the booth, while fresh water is supplied by a feed pipe 30 in such a quantity to replace water removed by evaporation from the water circulating within the booth.

A regenerative heat exchanger 32 interposed between the two ducts 12, 14 has a rotor which is driven by a motor 34. The rotor is in known manner formed with fine channels or passageways extending from end to end and at various places passed by the air streams propelled in the ducts, heat being transferred thereunder from the warmer to the cooler air stream. The rotor material is also capable of transferring moisture between the air streams. Positioned in the spray booth is position indicator 36 which serves to support the spray gun (not shown) used in the spraying operation and connected so to a control system as immediately to close the current supply to the driving motor of the pump 24 when the spray gun is lifted off from the position indicator, and thereby to initiate water circulation between the bottom water pool 28 and the sprinklers 20 which eject the water so as to form a curtain which effectively separates off the paint drops or particles which during the spraying operation have been spread out into the air. After having passed through the water curtain the air escapes from the booth through the outlet duct 14 over the heat exchanger 32 back into the atmosphere. When after finished spraying operation the spray pistol is put back onto or suspended on the position indicator 36 the water circulation is stopped, but not earlier but after some delay such as from 5 up to 120 seconds, i.e. after the time required for effecting thorough purification of the air in the booth from all dust particles still floating therein.

The control system further includes a temperature regulator 38 which is connected to a central control station 40 and over this latter determines the number of revolutions of the exchanger motor 34 and also a setting member 42 which actuates a multi-way valve 44. This valve is located in a conduit circuit 46 for hot water e.g. from a central source of hot water. The conduit circuit 46 further includes a pump 48 and a radiator 50 which is located in the duct 12 for the supply air admitted into the spray booth. The conduit circuit for the hot water may comprise a shunt conduit 52 via which depending on the set position of the valve 44 a major or minor quantity of water is circulated through the radiator 50 past the central hot water source depending on the heat requirement.

When the spray gun is put on or suspended from the position indicator 36, the water circulation in the working chamber of the booth is shut off, as mentioned above, whereas the fans 16, 18 are in operation so that air continuously is circulated through the booth and the heat exchanger 32. This implies that the air exhausted through the duct 14 generally speaking has the same temperature as in the working chamber of the spray booth behind the water curtain. If now the temperature of the admitted supply air is lower than that of the exhaust air the heat exchanger will transfer a fraction of the enthalpy of the exhaust air to the admitted supply air. The transferred heat can be varied by change of the number of revolutions of the exchanger motor 34 which is effected by actuation exercized by the temperature regulator 38 which thus is adjusted to the temperature desired to prevail inside the booth. If the heat exchanger transfers the maximum quantity of heat and the rotor thus rotates with a correspondingly high number of revolutions but the heat requirement in the booth still is not covered, the setting member 42 is actuated so as to cause a quantity of hot water depending on the setting of the valve 44 to pass through the radiator 50 via the circuit 46.

Figure 2:
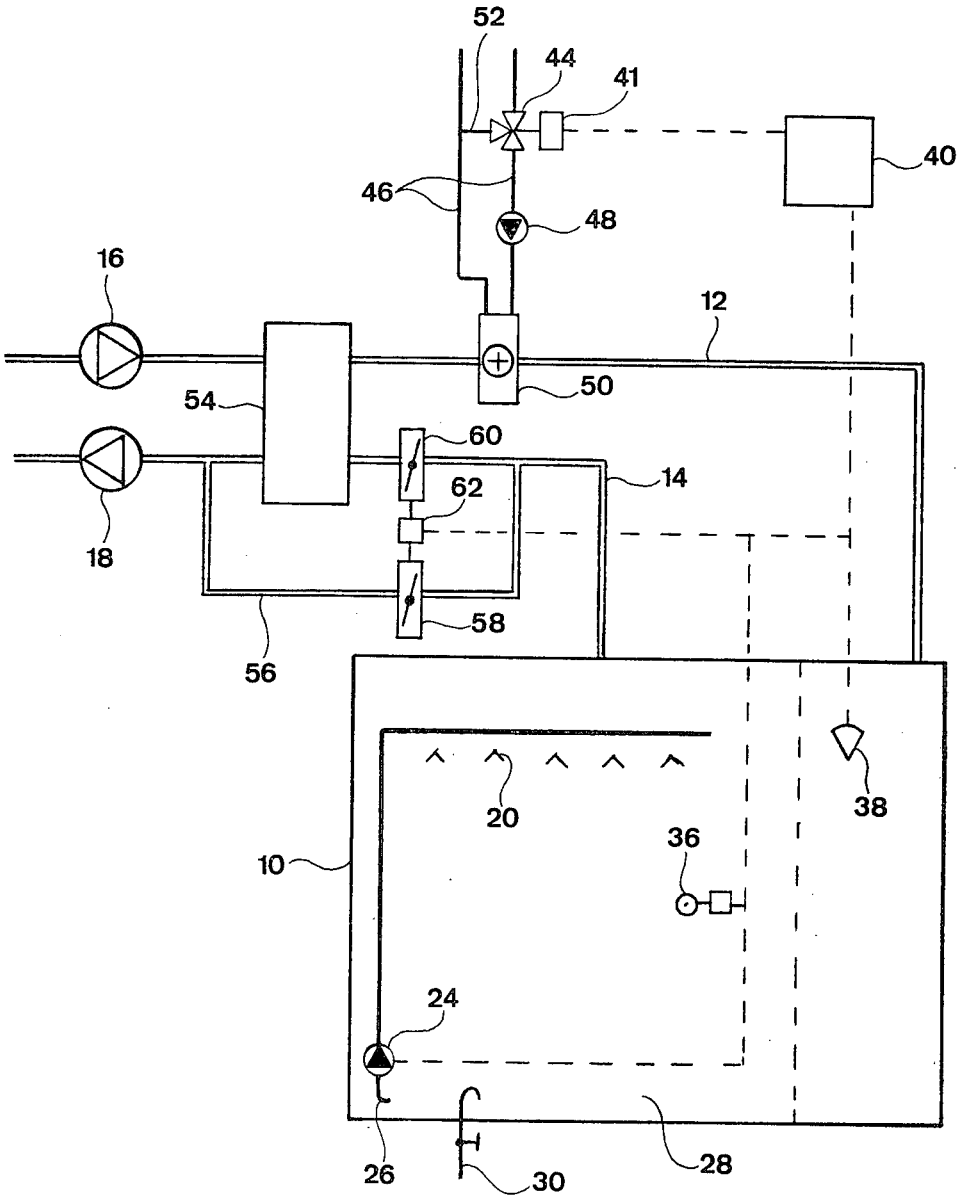

The embodiment illustrated in FIG. 2 differs from the preceding one mainly by the heat exchanger 54 being stationary, i.e. in known manner formed with two systems of passageways separated from one another and passed by streams of, respectively, supply air via the inlet duct 12 and exhaust air via the outlet duct 14, the common walls of these passageways being in heat-exchanging contact with the two air streams. A shunt duct 56 is connected to the outlet duct 14 on both sides of the heat exchanger 54. Located in this duct 56 is a baffle or valve 58 and in the duct 14 a baffle or valve 60 which both are actuated by the temperature regulator 38 through the central station 40 and a setting member 62. In this case the quantity of exhaust air passing through the heat exchanger is controllable by the setting member 62 causing the one of the two flaps 58, 60 to move towards open position and the other towards closed position. In this way the admitted supply air can be heated to a varying degree during the cold season by an impulse or exitation from the temperature regulator 38.

Figure 3:
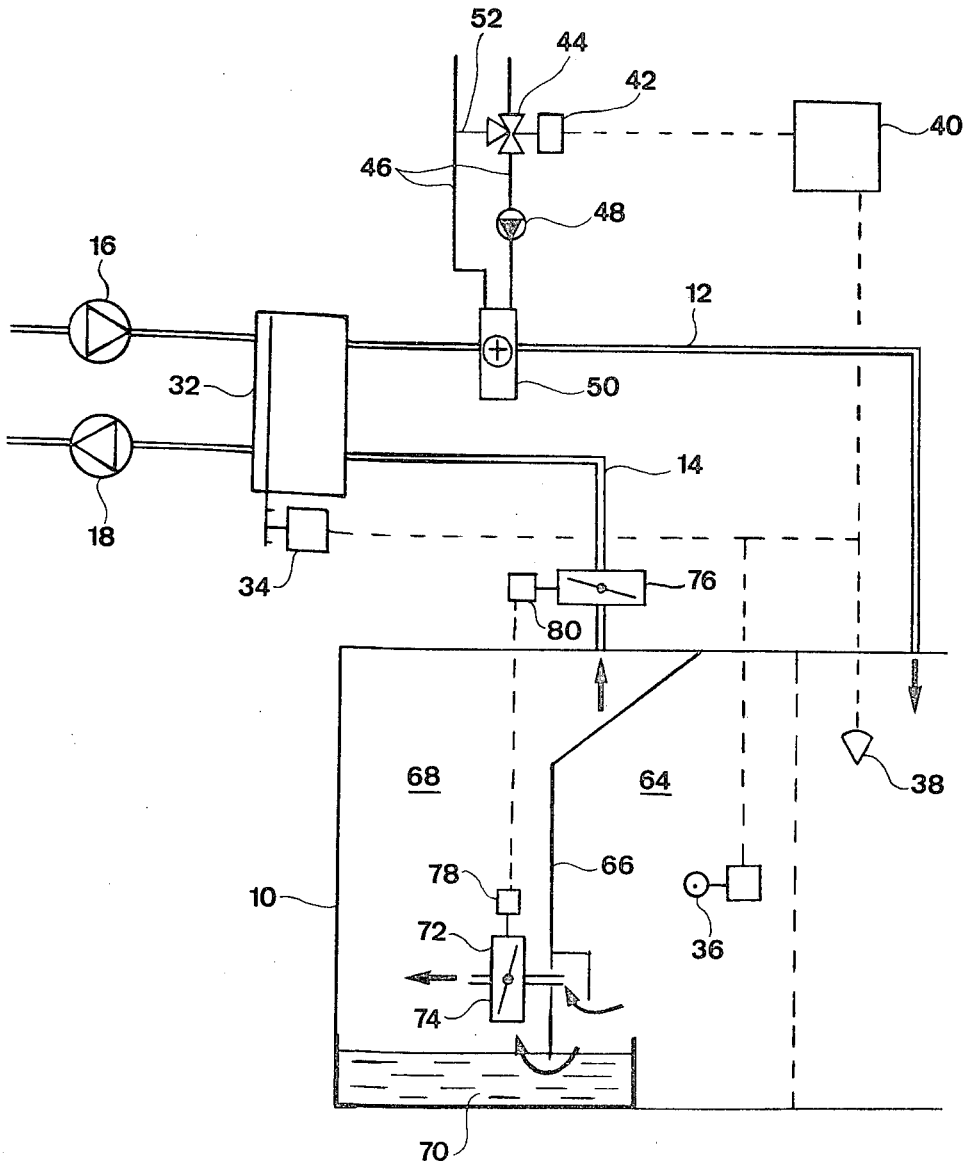

In the embodiment illustrated in FIG. 3 the heat exchanger 32 is of the rotatable type as in FIG. 1. The spray booth 10 has a space 64 within which the painting work is performed and a space 68 parted off by a wall 66 and in communication with the air exhaust duct 14. The bottom portion of the space 68 houses a water pool 70 which extends past the partition wall 66 into the working space 64, the partition wall 66 projecting downwards so as to reach adjacent or below the water surface in the pool. When a painting operation is being performed the air is forced to pass from the working space 64 through the water pool and thereafter upwards within the space 68. Thus in this case the water pool constitutes the pigment particles spearating water curtain by forming a cascade.

A baffle or valve 72 is positioned in a duct 74 which connects the two spaces 64 and 68 overhead of the surface of the water pool 70. Another baffle or valve 76 is located in the outlet duct 14 ahead of the heat exchanger 32. The two baffles 72 and 76 are actuated each by an associated setting member 78 and 80, respectively, on an impulse from the position indicator 38.

When a painting operation is being performed the air contaminated with paint particles is forced to pass through the water pool 70 where the paint particles are removed from the air in the manner described above. In this case the fan 18 has to generate a relatively great vacuum such as 100 mms water column in order to allow the air to overcome the resistance in the water pool 70. Under this operation the baffle 72 is closed and the baffle 76 open. When the spray gun is placed on the position indicator 36 the setting member 78 is actuated with delay in the same manner as already described above so that the baffle 72 opens wholly whereas the baffle 76 throttles so much as to cause the vacuum in the compartment to be reduced by e.g. one half to compensate for the disappearance of the pressure drop in the water pool 70. In this case also the room air in the booth will pass through the exchanger 32 without any increase of moisture or cooling effect so that the course of events with the spray gun inoperative and cold weather prevailing will become the same as related above.

Figure 4:
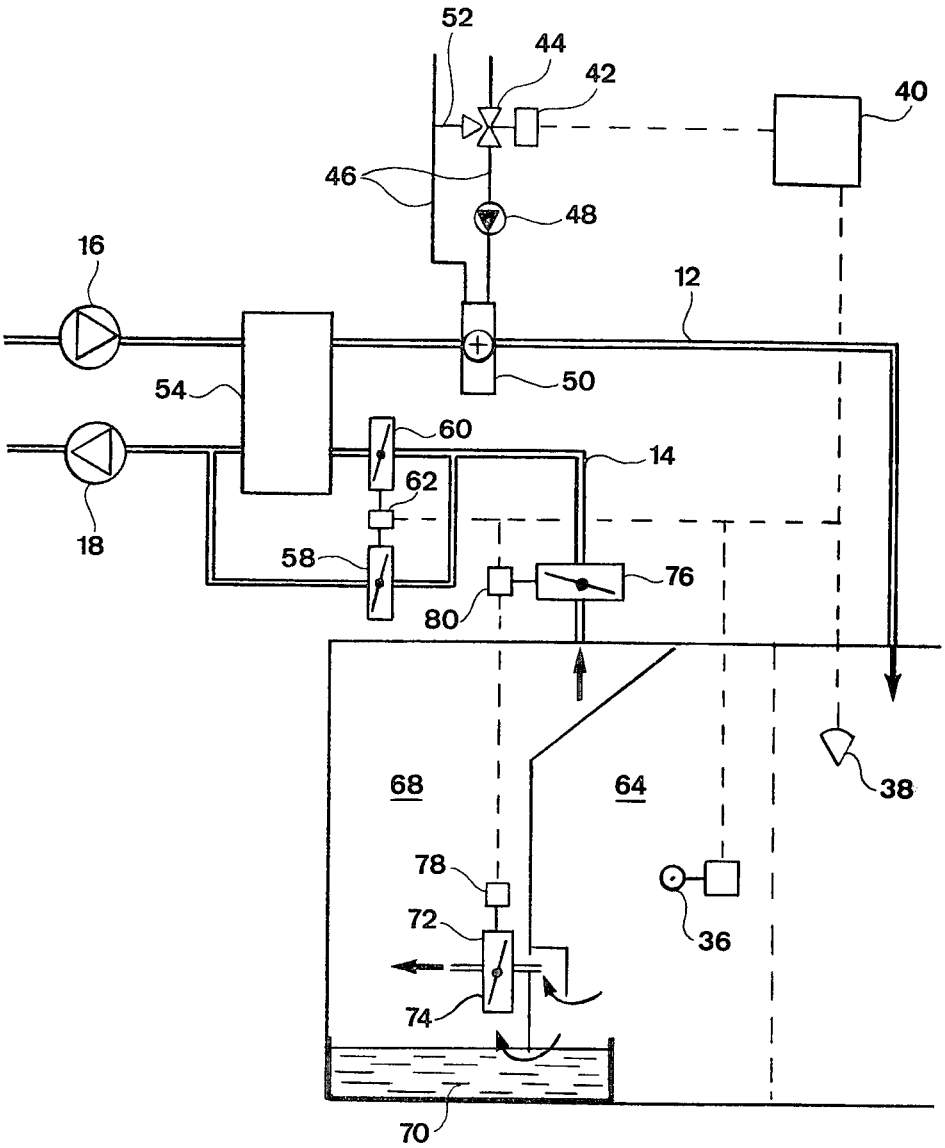

FIG. 4 illustrates an embodiment which is a combination of those shown in FIGS. 2 and 3, i.e. the heat exchanger 54 is of the stationary type and the water curtain is generated inside of the spray booth by the paint particles containing air being forced through a water cascade. Otherwise the course of operational steps is the same as is evident from the explanations given hereinbefore.

GRAPHICAL EXPLANATION OF ADVANTAGES OBTAINED

Figure 5:
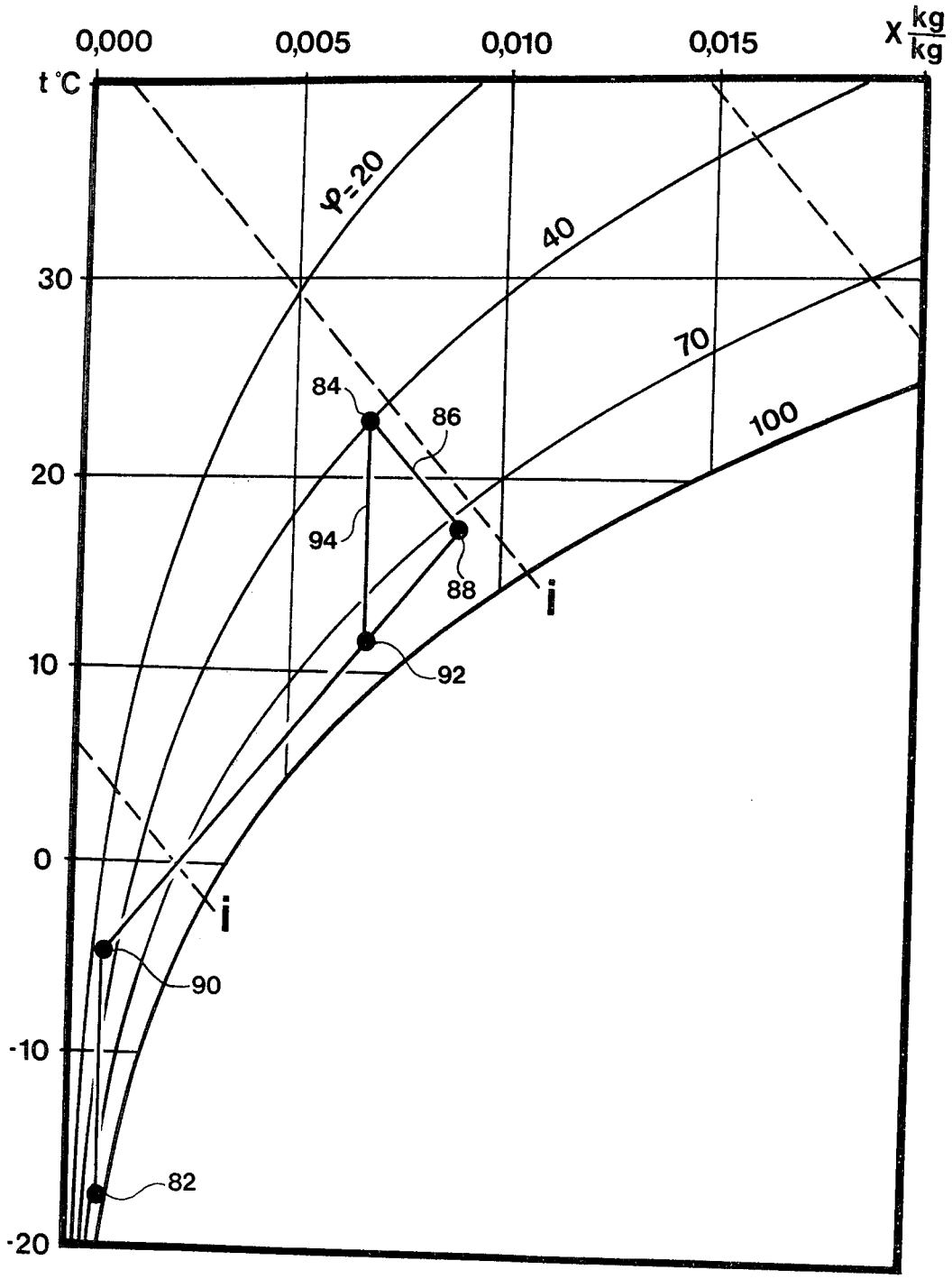
Figure 6:
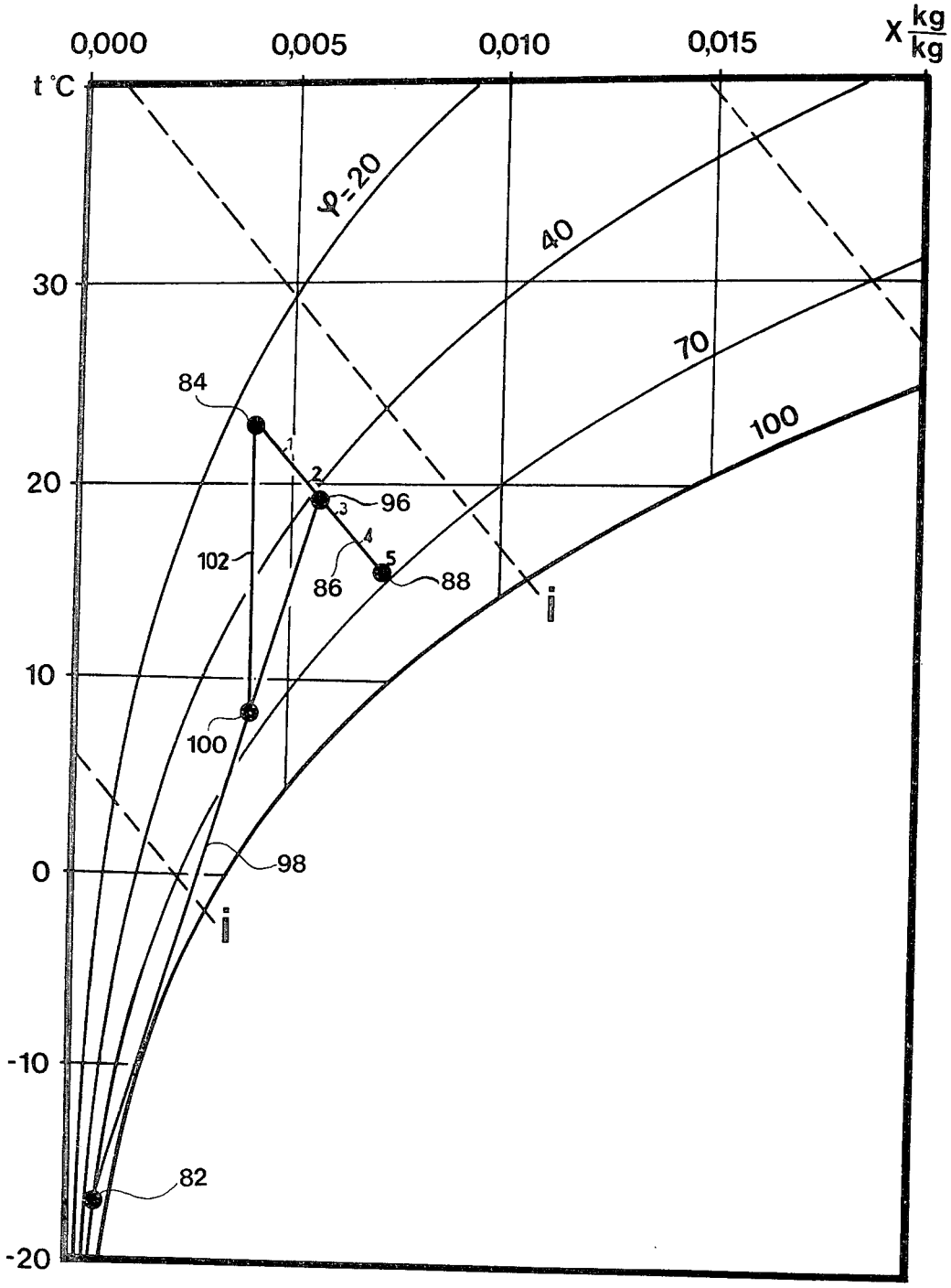
Figure 7:
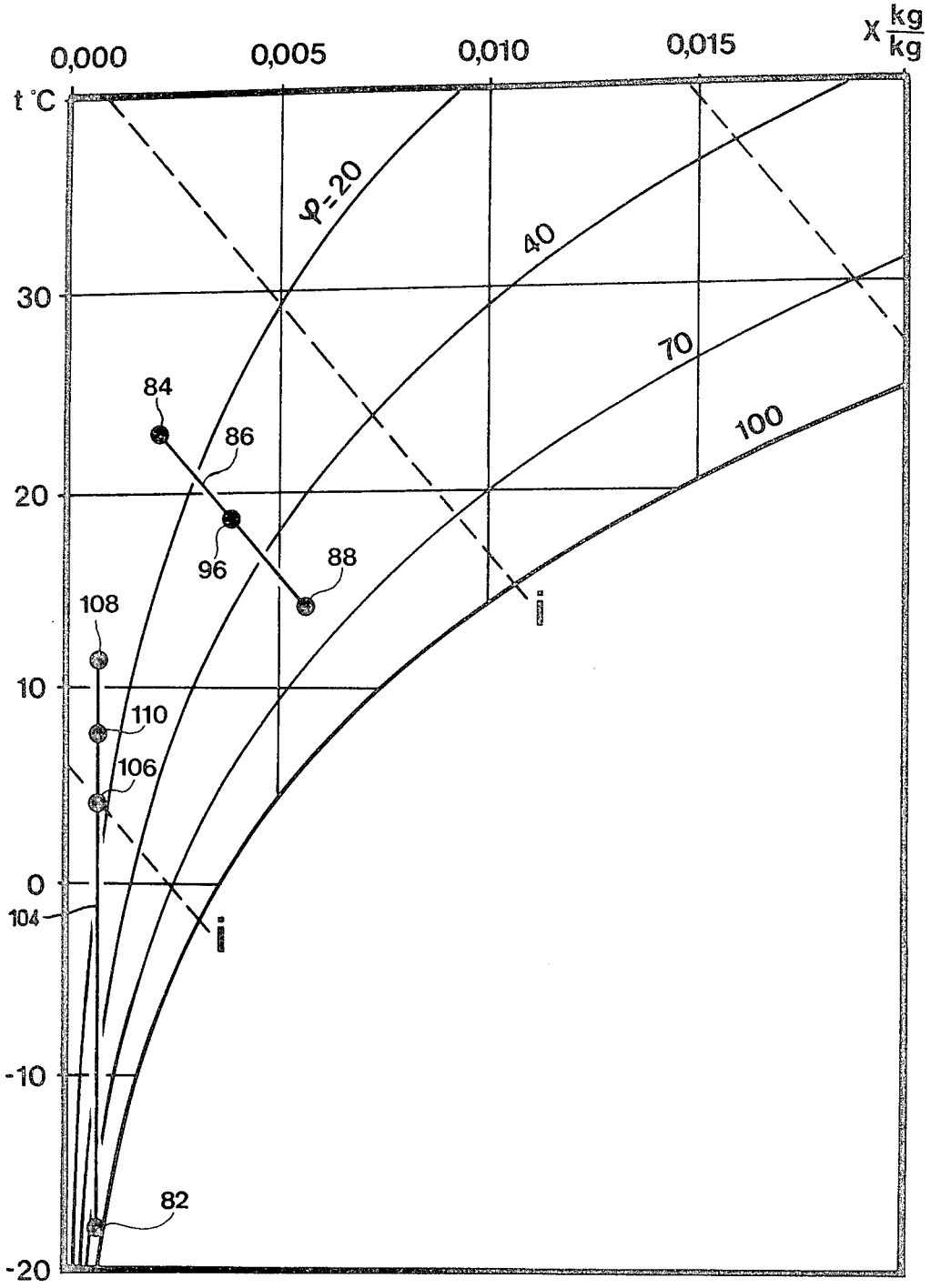

The FIGS. 5–7 show psychometric charts which indicate the moisture content of the air in kg.$10^{-3}$ per kg of air in relation to the air temperature. The bent curves indicate various relative moisture contents and the diagonal straight lines the heat content or enthalpy in kcal/kg.

As mentioned above, a spray booth usually comprises a plurality of compartments or units each of which is designed in the manner which becomes evident from e.g. the FIGS. 1–4. Each unit has separate connections for admitted supply air and discharged exhaust air which connections open into two main ducts passing through the heat exchanger. In the following the spray booth is assumed to contain five such units.

The chart shown in FIG. 5 illustrates the known state of art when attempting to use heat exchangers. The outdoor or atmospheric air is assumed to have state 82, i.e. a temperature of −18° C. and a relative moisture content of 90%. Prevailing in the working compartment of the spray booth may be a temperature of 23° C. and the air acquires according to FIG. 5 the condition according to point 84, i.e. a relative moisture content of 40%. The exhaust air takes up moisture according to enthalpy line 86 during the passage through the water curtain and is assumed to reach condition 88. Since all units in this case continuously are in full operation as far as the water curtain is concerned, the exhaust air from all units will have the same final condition according to point 88. If now this exhaust air exchanges heat content in a rotating exchanger with the outdoor air having the state 82, this would be effected along an assumed line which connects said points but which intersects the saturation curve for a relative moisture content of 100%. This means that moisture is precipitated in the passageways of the exchanger and is frozen to ice so that the exchanger will become clogged. In order to avoid this development one is compelled to preheat the admitted outdoor air so as according to the chart to reach point 90, and when now a heat exchange is performed in the heat exchanger with exhaust air having the condition 88 a point 92 straight below the point 84 can be reached with an exchanger efficiency of 70%. The exact adjustment of the temperature can be effected by control of the number of revolutions of the exchanger. The remaining heat demand is covered by subsequent heating following the line 94 up to the point 84. In this case a preheating is required and, moreover, the total efficiency becomes low due to the fact that the heat exchanger affords an increase of temperature of 16° C. only of the 41° C. required to ensure that the admitted supply air shall reach the desired room temperature.

FIG. 6 shows the working conditions for the embodiments represented in FIGS. 1 and 3. The desired condition 84 of the outdoor or atmospheric air is assumed to be the same as hereinbefore and also the room temperature to be 23° C. Since the various units are utilized during a fraction only of the working time, in the embodiment shown in FIG. 6 assumed to amount to 50%, the exhaust air during the passage through the heat exchanger acquires a condition 96 which is situated on the enthalpy line 86 midway between the points 84 and 88. Adjacent the line 86 the numerals 1 through 5 denote the changes of state which the exhaust air undergoes with varying numbers of booth units having their water curtains in action. As will be seen from the line 98 interconnecting the points 82 and 96 the heat content can now be exchanged between the admitted outdoor air and the exhaust air without intersection with the saturation curve for the relative moisture content of 100%, which means that no moisture is precipitated inside the exchanger. This exchanger is set to a number of revolutions, i.e. efficiency, until the admitted air has reached the condition 100, which is situated straight below the room condition 84. The heat which must be supplied from the radiator 50 is represented by line 102 and corresponds to 15° C. only. As will be seen the air supplied to the booth has a lower relative moisture content than in FIG. 5.

FIG. 7 shows the working conditions in the embodiments illustrated in FIGS. 2 and 4, i.e. with stationary exchangers having separate passageways for the admitted outdoor air and the exhaust air. In this case the admitted air thus undergoes an increase of temperature from the initial state or condition 82 along line 104 with unchanged moisture content. In this case the admitted air behind the exchanger reaches the condition 106 if all booth units are in operation. If all water curtains are out of operation the admitted air is heated in the exchanger to reach point 108 whereas its temperature corresponds to point 110 if the water charge is 50% corresponding to the point 96.

As is easily understood, the basically idea of the invention is the feature that a period of operation of the water curtain is coordinated with the length of time during which the fluid such as the paint leaves the spray gun in such a manner that the water curtain is initiated immediately with the start of fluid efflux from the gun and turned off but with some delay after that said efflux has been stopped.

While several more or less specific embodiments of the invention have been shown and described it is to be understood that this is for purpose of illustration only and that the invention is not to be limited thereby, but its scope is to be determined by the appended claims.

What is claimed is:

1. A device for use with a plurality of spray booths intended for spraying of articles passed by atmospheric air wherein air containing turbulent dust particles ejected from a spray gun during the spraying operation is forced to pass through a water curtain, said device including air inlet and outlet ducts communicating with each of said spray booths, a common heat exchanger disposed between said inlet and outlet ducts, and impulse means responsive to lifting of the spray gun for passing said air through the water curtain practically immediately on the start of operation of the gun until a predetermined delay after shut off of the operation of said gun.

2. The device of claim 1 including means in each of said booths for maintaining the temperature within the booth at a relatively constant predetermined level.

3. The device of claim 2, wherein each of the ducts contains fan means.

4. The device of claim 1, including means for supplying heat to air supplied to the booth through the inlet ducts downstream of the heat exchanger to vary the supply of heat to the air circulating through the booth including means for varying the activity of the heat exchanger and means for adjusting the quantity of heat supplied to the stream of supply air.

5. The device of claim 4, including a heat source being constituted by hot water.

6. The device according to claim 4, wherein the heat exchanger is of the rotatable type with a transfer rotor movable in a closed path between the air flows of the inlet and outlet ducts, said rotor including a driving motor adapted to be actuated by a temperature regulator for varying the number of revolutions of the rotor and thereby the heating of the admitted supply air.

7. The device of claim 4, wherein the heat exchanger being of the stationary type with separate passageways for each of the two air flows, the exhaust air outlet duct having a shunt duct pass the heat exchanger, said duct and a duct portion leading to the heat exchanger each having a baffle, said baffles being disposed to be acutated by a temperature regulator via the control circuit for variation of the flow of exhaust air through the heat exchanger and thereby the heating of the admitted supply air.

8. The device of claim 1 including means for forming said water curtain comprising a circulation pump and sprinklers, said impulse means being adapted to actuate the pump to cause the pump to start directly upon the spray gun being put into operation and to stop with a predetermined delay only after stoppage of the operation of the gun.

9. The device of claim 1, wherein the water curtain is a water pool, and a side wall on said booth extends downwardly in the pool separating the spray chamber proper and a suction chamber for the exhaust air booth into a spray which is subjected to a lower pressure than the spray chamber, said impulse means being adapted to actuate a baffle which during stoppage of operation of the spray gun opens a communication for the air between the two chambers overhead of the water pool.

10. The device of claim 9, including means for actuation of said baffle as well as another baffle located in the exhaust air outlet duct so as to cause the subpressure in the suction chamber to be reduced when the said operation conditions are prevailing.

* * * * *